United States Patent [19]

Algera

[11] Patent Number: 4,972,777

[45] Date of Patent: Nov. 27, 1990

[54] AMMUNITION FOR LIQUID PROPELLANT GUN

[75] Inventor: Robert A. Algera, Burlington, Vt.

[73] Assignee: General Electric Company, Burlington, Vt.

[21] Appl. No.: 840,075

[22] Filed: Oct. 6, 1977

[51] Int. Cl.[5] ..... F42B 5/00; F41F 1/04

[52] U.S. Cl. ..... 102/430; 89/7; 102/440

[58] Field of Search ..... 102/38 LP, 38 R, 38 CC; 89/7

[56] References Cited

U.S. PATENT DOCUMENTS

| | | | |
|---|---|---|---|
| 911,796 | 2/1909 | Wratzke | 102/430 |
| 1,109,840 | 9/1914 | Hoagland | 102/430 |
| 1,879,278 | 9/1932 | Jacobs | 102/430 |
| 2,573,451 | 10/1951 | Keller et al. | 102/469 |
| 3,009,394 | 11/1961 | Kamp et al. | 102/434 |
| 3,049,998 | 8/1962 | Brown | 102/442 |
| 3,749,020 | 7/1973 | Weyhmuller | 102/430 |
| 3,803,975 | 4/1974 | Elmore et al. | 102/440 X |

*Primary Examiner*—David H. Brown

*Attorney, Agent, or Firm*—Bailin L. Kuch

[57] ABSTRACT

A round of ammunition is provided including a stub cartridge case carrying a primer, a booster, and a projectile having a plurality of longitudinally extending grooves in its base which are obturated by the case.

9 Claims, 3 Drawing Sheets

AMMUNITION FOR LIQUID PROPELLANT GUN

BACKGROUND OF THE INVENTION

1. Field of the Invention

This invention relates to ammunition for liquid propellant guns utilizing bulk supplies of liquid propellant.

2. Prior Art

Liquid propellant gun prototypes are known, and are of two broad types: guns which utilize rounds of ammunition which are preloaded with liquid propellant; and guns which utilize a bulk supply of liquid propellant from which a quantity is dispensed for each projectile as it is fired. Exemplars of the first type are found in U.S. Pat. No. 3,690,255 issued Sept. 12, 1972 to E. J. Vass et al; U.S. Pat. No. 2,960,031 issued Nov. 15, 1960 to G. D. Clift; U.S. Pat. No. 3,011,404 issued Dec. 5, 1961 to C. R. Russell; and Ser. No. 707,144 filed July 20, 1976 by E. Ashley. Exemplars of the second type are found in U.S. Pat. No. 3,803,975 issued April 16, 1974 to L. C. Elmore et al; and in U.S. Pat. No. 4,023,463 issued May 17, 1977 to D. P. Tassie and in the background and prior art patents discussed therein.

RELATED APPLICATION

A liquid propellant gun, particularly adapted to utilize the ammunition disclosed and claimed in this application, is disclosed and claimed in the application of M. J. Bulman Ser. No. 840,074, filed Oct. 6, 1977.

SUMMARY OF THE INVENTION

An object of this invention is the provision of a round of ammunition for a bulk supplied liquid propellant gun utilizing a regenerative piston which provides a booster charge output having a ramp rather than a step function to actuate the regenerative piston.

A feature of this invention is the provision of a round of ammunition including a stub cartridge case carrying a primer, a booster, and a projectile having a plurality of longitudinally extending grooves in its base which are obturated by the case.

DESCRIPTION OF THE INVENTION

Figure 1:
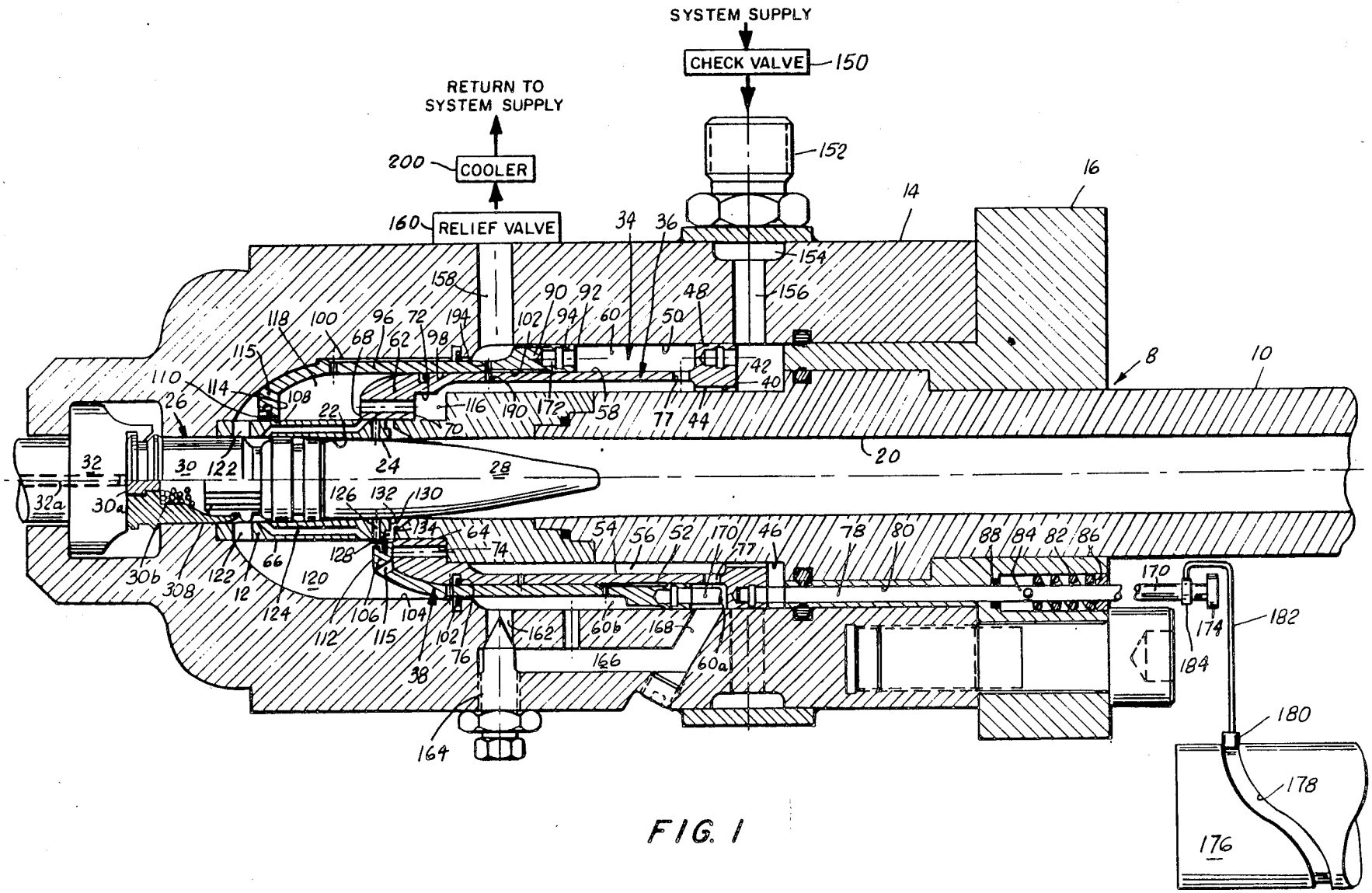
FIG. 1 is a view in elevation, in longitudinal cross-section, of a gun system utilizing ammunition embodying this invention. The lower half of the view shows the assembly prior to filling with liquid propellant, while the upper half shows the assembly after filling and prior to firing.
Figure 2:
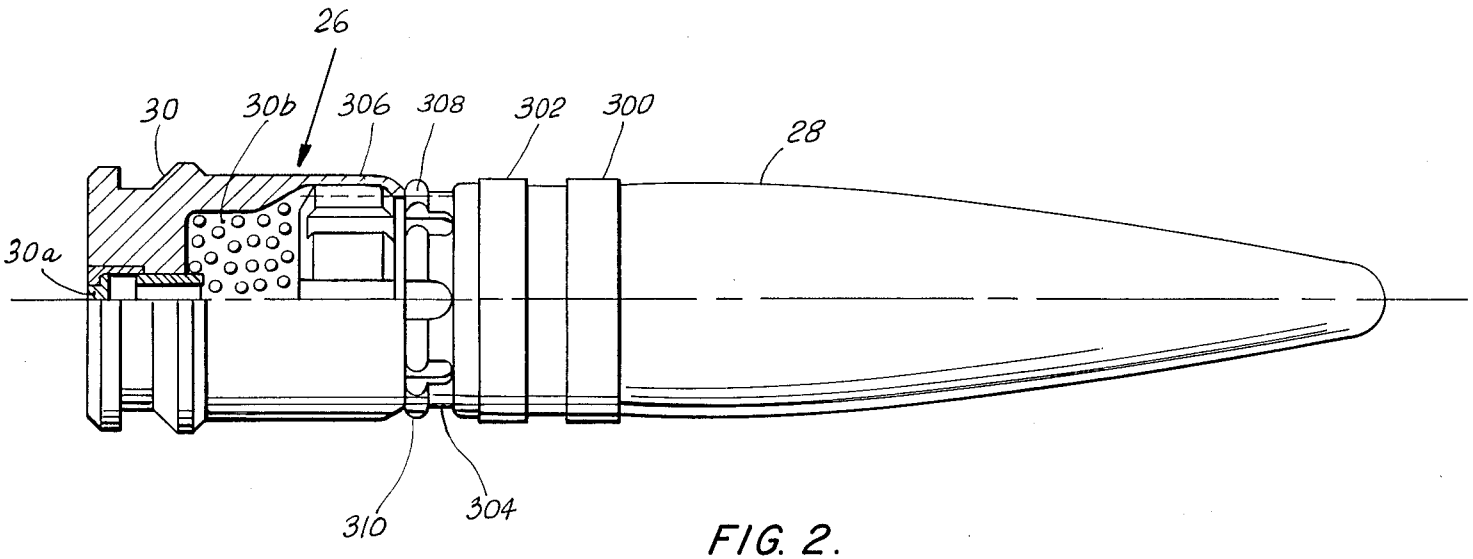
FIG. 2 is a view in elevation of the round of ammunition of FIG. 1.

The gun system includes a gun barrel assembly 8 which consists of a forward barrel which is fixed to a barrel extension 12 within a housing 14 by a cover 16. The barrel assembly has a rifled firing bore 20, a projectile receiving chamber 22 which also serves as a combustion chamber, and an intermediate forcing cone 24. A round of ammunition 26 comprising a projectile 28 crimped to a stub case 30 having a percussion primer **30*a* and a booster charge 30*b* is chambered, locked and extracted by a conventional bolt 32. The projectile has two rotating bands 300 and 302, and a base portion 304 which is received into the neck 306 of the case 30. A plurality of longitudinally extending grooves 308 is formed in the base, the forward end of each groove extending forwardly beyond the forward edge of the neck which abuts against an annular ridge 310 formed on the base. The forward edge of the neck is dimpled into each groove 308 to seal in the booster 30*b***; however the internal gas pressure required to deflect open these dimples is significantly less than that required to advance the projectile forwardly out of the neck of the case. The grooves provide a direct path for combustion gas as it is generated at initially a relatively low pressure by the booster to escape from the case, and avoids the sudden impact of gas at a high pressure as would otherwise occur when the projectile exits from the case.

The barrel assembly in conjunction with the housing 14 define a substantially hollow cylindrical cavity 34 in which are telescopically disposed a substantially hollow cylindrical valve 36 and a substantially hollow cylindrical piston 38.

The valve 36 includes a forward annular portion 40 having an inner wall surface 42 providing an annular gap or passageway 44 adjacent the outer wall surface 46 of the barrel and an outer wall surface 48 journaled on the inner wall surface 50 of the housing and substantially sealed thereto. The annular portion 40 is integral with an intermediate tubular portion 52 having an inner wall surface 54 providing an annular cavity 56 adjacent the outer wall surface 46, and an outer wall surface 58 providing an annular cavity 60 adjacent the inner wall surface 50 of the housing. The intermediate portion 52 is integral with an aft annular portion 62 having an inner wall surface 64 journaled on the outer wall surface 66 of the barrel extension and substantially sealed thereto, a transverse aft surface 68, a transverse forward surface 70, an inner annular surface 72, a plurality of longitudinal bores or passageways 74 extending between the surfaces 68 and 70, and a ring seal 76 disposed in an annular groove in the outer wall surface 58. A plurality of radial bores 77 are also provided in the intermediate portion 52 to provide a passageway between the inner cavity 56 and the outer cavity 60. Two rods 78 have their aft ends respectively fixed to the forward annular portion 40, and pass through bores 80 in the housing. The rods are each biased aftwardly by a respective helical compression spring 82 captured between a cross pin 84 on the rod and a plug 86 in the housing. Each rod may have a respective seal 88.

The piston 38 includes a forward annular portion 90 having an inner wall surface 92 journaled on the surface 58 of the valve and an outer wall surface 94 journaled on the surface 50 of the housing. The annular portion 90 is integral with an intermediate tubular portion 96 having an inner surface 98 bearing against the ring seal 76 in the valve, and an outer surface 100 bearing against a high performance ring seal 102 disposed in an annular groove in the inner surface 104 of the housing. The intermediate portion 96 is integral with an aft annular portion 106 having an inner wall surface 108 in which is mounted an L type ring seal 110 which is journaled on and seals to the outer surface 66 of the barrel extension, a transverse aft surface 112, a transverse forward surface 114, and a plurality of bores or passageways 115 extending between the surfaces 112 and 114. It will be seen that the effective cross-sectional area of the forward surface 114 is less than the effective cross-sectional area of the aft surface 112, providing the piston sleeve 38 with a differential piston action.

The barrel extension 12, the valve 36 and the piston 38, depending on their mutual positioning, may be considered to define a liquid propellant supply cavity 116, a pumping cavity 118, and an additional combustion cavity 120. The barrel extension 12 has a first plurality of radial passageways 122 disposed aft in an annular row, serving as passageways between the combustion chamber 120 and the projectile chamber 22; a second plurality of passageways 124, a third plurality of passageways 126 and a fourth plurality of passageways 128, each plurality disposed in a respective annular row and serving as passageways between the pumping chamber 118 and the projectile chamber 22. The passageways 128 comprise a plurality of radial bores terminating in a common annular groove 130 providing a shoulder 132 partially obstructing each bore in the aft firing bore direction and a surface 134 at an obtuse angle to the surface of the firing bore in the forward direction.

A check valve 150 is coupled to an inlet 152 in the housing 14 which leads to an annular passageway 154 in the housing, from which a plurality of radial bores 156 lead to and through the forward portion of the surface 50. A radial bore 158 leads through and from the surface 50 aft of the annulus 90 of the piston 38 to a relief valve 160. A radial bore 162 aft of the annulus 90 of the piston 38, in which is seated a needle valve 164, communicates with a bore 166, which communicates with a bore 168 which leads to and through the surface 50 forward of the annulus 90.

Two rods 170 and 172 have their aft ends respectively fixed to the forward annular portion 90 of the piston 38, and pass through bores with seals in the housing which are similar to the bores 80. The forward ends of the rods respectively terminate in an enlargement 174. A drum cam 176, such as is shown in U.S. Pat. No. 3,763,739 filed June 1, 1971, by D. P. Tassie, has a helical control track 178 in which rides a cam follower 180 which has an arm 182 which terminates in a rod follower 184. The rods are free to move forwardly free of the follower 180, but are controlled in their movement aftwardly by the cam track 178 via the followers 180 and 184. The cam track 178 is also able to pull the rods forwardly via the followers 180 and 184.

OPERATION

Figure 4:
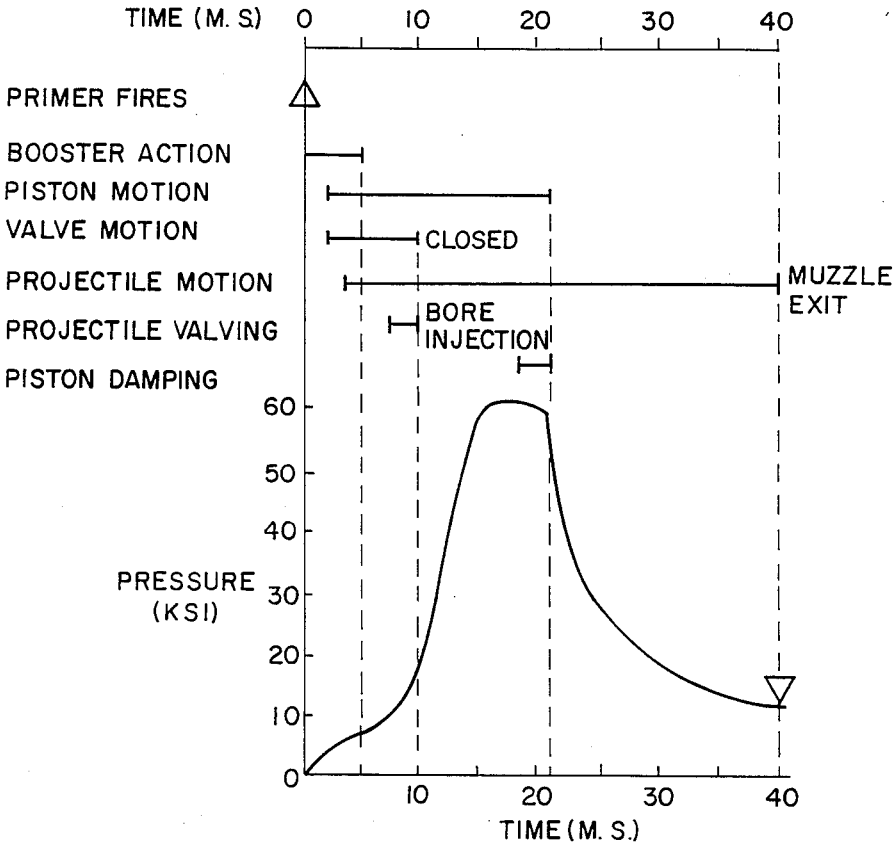
FIG. 4 is a chart of cycle of operation of the gun system of FIG. 1.

An exemplary gun cycle is shown in FIG. 4.

After firing is completed, the piston 38 and the valve 36 are in their nested, forwardmost positions, as shown in the lower half of FIG. 1. The surface 48 of the valve annulus 40 serves to close the supply bores 156. After pressure in the combustion chamber is adequately vented and when allowed by the cam 176, the springs 82 biasing the rods 78 shift the valve aft to the position shown in the upper half of FIG. 1. The piston is still nested on the valve. As the valve is shifted aft, the supply bores 156 are uncovered by the surface 48, admitting liquid propellant forward of the annulus 40. The propellant flows through the annular passageway 44 into the cavity 56, through the passageways 77 into the cavity 60, into the supply cavity 116 and into the bores 74. When allowed by the cam 76, the pressure of the propellant unnests the piston aftwardly from the valve to define the pumping cavity 118 into which propellant flows from the bores 74. In the aftmost position of the valve, the surface 64 closes the inlet ends of all three pluralities of bores 124, 126 and 128. Thus no propellant can enter these bores and pass to the projectile chamber 22. Various bores, typically 190, are provided to insure that the running surfaces between the valve and the piston 98 and 58 are lubricated with propellant. Additional bores, typically 194, are provided to assist in purging air from the system.

The round of ammunition 26 is inserted into the projectile chamber 22 by the bolt 32. The bolt is locked.

The firing pin **32*a* of the bolt 32 percusses the primer 30*a*, the primer fires and ignites the booster charge 30*b*. The combustion gas from the booster charge initially exits through the grooves 308 and subsequently unseats the projectile from its case forwardly. Combustion gas passes through the bores 122 into the combustion chamber 120 and applies force against the aft face 112 of the piston, moving the piston forwardly to commence compression of the liquid propellant in the pumping chamber. Some propellant passes through the bores 115 into the combusion chamber and is ignited. The valve is moved forwardly to commence reducing the volume of the supply cavity 116. When the forward corner of the surface 72 of the valve reaches the aft corner of the surface 46 of the barrel extension, the supply cavity 116 becomes a closed cavity whose only outlet is the bores 74, thereby providing a dash-pot action to cushion the nesting of the valve onto the barrel extension. While the projectile is in the projectile chamber 22 it closes the outlets of the plurality of bores 128 and the plurality of bores 126 and 124. As the valve moves forward it first uncovers the inlets of the bores 124 which permits the passage of liquid propellant from the pumping chamber 118 into the aft portion of the projectile chamber where it is ignited by the combustion gas from the booster charge, to increase the acceleration of the projectile over what has been provided by the booster charge per se and the propellant from the bores 115. When the valve is partially closed onto the barrel extension it uncovers the inlets to the bores 126, and when it is fully closed, it uncovers the inlets to the bores 128. When the projectile has moved forwardly down the firing bore 20 to uncover the outlets of the bores 126 and 128, additional liquid propellant is injected through these bores into the projectile chamber 22 and ignited. As liquid propellant passes out of the bores 128 into the annulus 130 it is deflected by the bulk combustion gas flow forwardly through the projectile chamber to provide a continuously replenished film or tube of liquid on the surface 134 which extends forwardly (down-stream) along the surface of the firing bore 20. This tube of liquid propellant encircles and feeds a tubular combustion zone. The tube of film insulates the adjacent surface of the firing bore from the heat of the combustion zone. As the piston closes forwardly on the valve it also is a closed cavity whose only outlets are the bores 115, 124, 126 and 128**, thereby providing a dash-pot action to cushion the nesting of the piston onto the valve.

As the piston moves forwardly during the firing subcycle, the annular portion 90 pushes against liquid propellant ahead of it in the forward portion **60*a* of the cavity 60. This forward portion serves as a closed cavity whose only outlets are the bores 77 and the bore 168. The bores 77 lead only to the cavity 56, which when the valve sleeve is in its forward nested position, is itself a fully closed cavity. The bore 168 communicates via the bore 166, the needle valve 164 and the bore 162 with the aft portion 60*b* of the cavity 60. The aft portion increases in volume as the forward portion decreases in volume. The rate of transfer between the portions is controlled by the needle valve. Thus, the cavity 60 with the needle valve circuit serves as an injection rate control system yielding direct performance adjustment. Any surplus liquid propellant developed as the difference between the volumes of the forward and the aft portions of the cavity 60 may be discharged via the pressure relief valve 160. Such discharged liquid propellant may be either dumped and lost, or passed through a cooling system 200**, e.g. a radiator, and then returned to the liquid propellant supply system. A higher than conventional ratio of injection pressure to chamber pressure, e.g. 1.4 to 1, rather than 1.2 to 1, may be provided to permit a high initial acceleration until the valve sleeve closes and the needle valve circuit assumes control.

It will be noted that the cam track 178 serves to control the filling subcycle by its restraint of the aftward movement of the piston 38. It does not control or hinder the forward movement of the piston. However, should a misfire occur, such that the piston does not move forwardly during the time interval alloted to the firing cycle, then the cam track 178, via the followers 184 engaging the rod enlargements 174, will shift the piston forwardly. As the piston moves forwardly, the liquid propellant in the pumping cavity 118 is forced through the bores 74 into the supply cavity 116 and the cavity 56, through the bores 77 into the cavity 60, through the needle valve circuit and out through the pressure relief valve 160.

The booster **30*b*** is made powerful enough, so that, if ignited, it will generate a volume of combustion gas adequate to force the projectile forwardly through the length of the firing bore and out of the gun.

After the completion of the firing cycle, the bolt is unlocked and extracts the cartridge case. If a misfire has occurred such that the primer did not ignite the booster, the projectile will be extracted with the cartridge case. If the booster did ignite, only the cartridge case will remain with the bolt for extraction.

Figure 3:
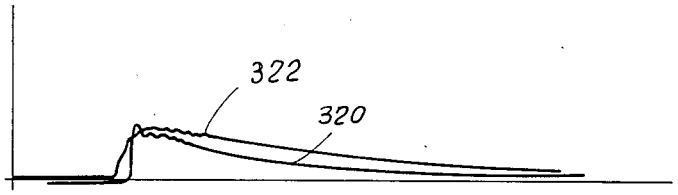
FIG. 3 is a chart of chamber pressure against time for a convention round, and for the round of ammunition of FIG. 2.

FIG. 3 is a chart of chamber pressure vs time showing at 320 the chamber pressure developed by a conventional 30 mm round having a step like initial rise and showing at 322 the chamber pressure developed by a 30 mm round embodying this invention having a ramp or sloped initial rise.

What is claimed is:

1. A round of ammunition comprising:
a cartridge case having an open end;
a projectile disposed at least in part in said case and fixedly rigidly closing said open end;
means for generating combustion gas within said cartridge case for ejecting said projectile from said case to open said closed end of said case;
means for passing combustion gas out of said case prior to the ejection of said projectile from said case.

2. A round of ammunition comprising:
a projectile having
a forward portion,
a base portion having an aftmost subportion and a forwardmost subportion,
a plurality of longitudinally extending grooves in the exterior surface of said aftmost subportion and said forwardmost subportion, each groove having a forward termination aft of said forward portion;
a case having
a base portion and
a neck portion,
said aftmost subportion of said base portion of said projectile fixed within said neck portion of said case,
said forwardmost subportion of said base portion of said projectile disposed without said neck portion of said case;
said neck portion of said case obturating said plurality of grooves and having a mode of operation such that the force required to open said obturation of said groove is less than the force required to eject said projectile from said case.

3. A round according to claim 2 wherein:
the forward margin of said neck of said case serves to obturate each of said grooves.

4. A round of ammunition comprising:
a projectile having
a forward portion and
a base portion with a longitudinally extending groove therein;
a case having
a base portion and
a neck portion,
a portion of said base portion of said projectile being rigidly fixed within and closing said neck portion of said case,
said neck portion of said case obturating said groove and having a mode of operation such that the force required to open said obturation of said groove is less than the force required to eject said projectile from said case.

5. A round of ammunition according to claim 4 wherein said groove is one of a plurality of such grooves.

6. A round of ammunition comprising:
a projectile having
a forward portion,
a base portion having an aftmost subportion and a forwardmost subportion,
a longitudinally extending groove formed in the exterior surface of said aftsubportion and said forwardmost subportion, and having a forward termination aft of said forward portion; and
a case having
a base portion, and
a neck portion,
said aftmost subportion of said base portion of said projectile fixed within said neck portion of said case,
said forwardmost subportion of said base portion of said projectile disposed without said neck portion of said case.

7. A round according to claim 6 further including:
a primer and a booster carried by said case.

8. A round according to claim 6 wherein:
said neck portion of said case obturates said groove.

9. A round according to claim 8 so constructed and arranged that:
The force required to open said obturation of said groove is less than the force required to eject said projectile from said case.

* * * * *